US008820128B2

(12) United States Patent
Liu

(10) Patent No.: US 8,820,128 B2
(45) Date of Patent: Sep. 2, 2014

(54) ANTI-PICKING DEVICE FOR LOCK AND KEY THEREOF

(71) Applicant: Shih-Te Liu, Kaohsiung (TW)

(72) Inventor: Shih-Te Liu, Kaohsiung (TW)

( * ) Notice: Subject to any disclaimer, the term of this patent is extended or adjusted under 35 U.S.C. 154(b) by 0 days.

(21) Appl. No.: 13/685,830

(22) Filed: Nov. 27, 2012

(65) Prior Publication Data

US 2013/0139562 A1 Jun. 6, 2013

(30) Foreign Application Priority Data

Dec. 5, 2011 (TW) ..... 100144610 A
Nov. 20, 2012 (TW) ..... 101143333 A

(51) Int. Cl.
*E05B 19/00* (2006.01)
*E05B 15/08* (2006.01)
*E05B 17/14* (2006.01)

(52) U.S. Cl.
CPC ..... *E05B 17/142* (2013.01); *E05B 17/14* (2013.01)
USPC ..... 70/395; 70/408; 70/423; 70/427; 70/454; 70/455

(58) Field of Classification Search
USPC ..... 70/395, 408, 423–428, 453–455, 70/DIG. 38
See application file for complete search history.

(56) References Cited

U.S. PATENT DOCUMENTS 312,545 A 2/1885 Zeilin
2,198,484 A 4/1940 Merkl
2,724,959 A 11/1955 Young et al.
3,208,249 A 9/1965 Stackhouse
3,630,053 A * 12/1971 Krakauer ..... 70/51
3,714,804 A * 2/1973 French ..... 70/419
3,765,199 A * 10/1973 Wiczer ..... 70/423
3,834,198 A * 9/1974 Wiczer ..... 70/208
5,077,996 A 1/1992 Lien
5,329,792 A 7/1994 Lee
6,494,064 B1 12/2002 Pena
7,866,194 B2 * 1/2011 Liu ..... 70/395
8,347,679 B2 * 1/2013 Liu ..... 70/395
8,397,547 B2 * 3/2013 Liu ..... 70/395
2003/0159481 A1 8/2003 McGuire et al.
2010/0077812 A1 * 4/2010 Liu ..... 70/348

FOREIGN PATENT DOCUMENTS

TW M287361 2/2006

* cited by examiner

*Primary Examiner* — Christopher Boswell
(74) *Attorney, Agent, or Firm* — Alan Kamrath; Kamrath IP Lawfirm, P.A.

(57) ABSTRACT

An anti-picking device for a lock includes a casing, a rotating body, a key guiding seat and a linking member. The casing has a compartment. The rotating body is rotatably received in the compartment and has an actuated member adapted to rotate the rotating body relatively to the casing and an insertion hole axially connecting two end faces of the rotating body. The key guiding seat is received in the compartment and has an arc guiding groove and a receiving hole. The arc guiding groove communicates with the receiving hole, and the receiving hole penetrates through the key guiding seat in the axial direction. The linking member is received in the receiving hole of the key guiding seat and has an engaging part at a first end, while a second end of the linking member extends out of the receiving hole.

15 Claims, 5 Drawing Sheets

ANTI-PICKING DEVICE FOR LOCK AND KEY THEREOF

BACKGROUND OF THE INVENTION

1. Field of the Invention

The present invention relates to an anti-picking device and the key thereof and, more particularly, to an anti-picking device with multiple protective strategies and a key to be operated by the anti-picking device for locking and unlocking a lock core.

2. Description of the Related Art

Conventional locks include one or more lock cores that can be rotated for locking or unlocking purposes. The keyholes of the lock cores are generally exposed for receiving keys. However, the locks are liable to be picked through the exposed keyholes. Furthermore, the keys could be copied by probing the shapes of the exposed keyholes.

In order to prevent the lock cores from being picked through the keyholes, an invention disclosed by Taiwan Utility Model No. M287361 entitled "SAFETY LOCK WITH CONCEALED KEYHOLE" as shown in FIG. 1 is previously proposed. The conventional anti-picking device 9 has a lock core 91 and a cover 92, with the cover 92 having an opening 921 aligning with a keyhole 911 of the lock core 91. A magnetic board 93 is mounted beneath the cover 92 and includes a through-hole 931 aligned with the opening 921 and having a diameter slightly smaller than the opening 921. A decorative cover 94 can be retained in the opening 921 by magnetic attraction to conceal the keyhole 911. However, the decorative cover 94 can be easily removed by a magnet having a larger magnetic attraction than the magnetic board 93 or by picking the decorative cover 94 through a gap between the decorative cover 94 and an inner periphery of the opening 921. Accordingly, the decorative cover 94 can be easily removed to reveal the keyhole 911 and cannot provide a desirable anti-picking effect. Furthermore, a burglar may easily pick the lock core 91 through the keyhole 911 once the decorative cover 94 is removed, since the lock core 91 is operated by a teeth portion 951 of a key 95 with such a simple structure. As a result, it is necessary to improve the conventional anti-picking device 9.

SUMMARY OF THE INVENTION

It is therefore the objective of this invention to provide an anti-picking device capable of concealing a keyhole of a lock to prevent the keyhole from being picked.

It is another objective of this invention to provide an anti-picking device for a lock having multiple guard strategies.

It is a further objective of this invention to provide a key of an anti-picking device for a lock specifically corresponding to the anti-picking device in order to operate the lock via the anti-picking device.

One embodiment of the invention discloses an anti-picking device for a lock, which includes a casing, a rotating body, a key guiding seat and a linking member. The casing has a first end, a second end and a compartment. The first and second ends serve as two opposite ends of the casing in an axial direction, the first end has a first opening while the second end has a second opening. The first and second openings communicate with the compartment. The rotating body is rotatably received in the compartment. The rotating body has a first end face facing the first opening, a second end face facing the second opening, an actuated member adapted to rotate the rotating body about a central axis of the casing within a rotation range, and an insertion hole extending from the first end face to the second end face in the axial direction to form a third opening in the first end face and a fourth opening in the second end face. The key guiding seat is received in the compartment and has an arc guiding groove and a receiving hole. The arc guiding groove communicates with the receiving hole, and the receiving hole penetrates through the key guiding seat in the axial direction. The linking member is rotatably received in the receiving hole of the key guiding seat and has an engaging part at a first end, while a second end of the linking member extends away from the rotating body and out of the receiving hole. The third opening keeps in an opening range of the first opening when the rotating body rotates within the said rotation range for the insertion hole to communicate with or be apart from the receiving hole.

In a preferred form shown, a cross-section of a front part of the insertion hole is non-circular.

In the preferred form shown, a cross-section of the engaging part is in correspondence with the cross-section of the front part of the insertion hole.

In the preferred form shown, the anti-picking device for the lock further comprises an outer shield. The outer shield is disposed at the second end of the casing and is able to slide relatively to the casing, and the second end of the linking member penetrates the outer shield.

In the preferred form shown, the outer shield has a notch communicating with the arc guiding groove of the key guiding seat.

In the preferred form shown, the key guiding seat has at least one positioning module, while the outer shield further has a first positioning member and a second positioning member, with the at least one positioning module able to be engaged with the first positioning member or the second positioning member.

In the preferred form shown, the engaging part has an engaging slit extending in an arc route about the central axis of the casing.

In the preferred form shown, the receiving hole has a first section and a second section, with the first section communicating with the arc guiding groove and able to receive the engaging part of the linking member, and with a cross-section of the first section of the receiving hole being larger than a cross-section of the second section.

In the preferred form shown, in cross-sections of the key guiding seat and the outer shield perpendicular to the central axis of the casing, the arc guiding groove and the notch extend in a circle centering on the central axis.

In the preferred form shown, the engaging part has an engaging slit extending in an arc route about the central axis of the casing, and, in cross-sections of the key guiding seat, the linking member and the outer shield perpendicular to the central axis of the casing, the arc route of the engaging slit is able to be in the circle.

In the preferred form shown, in cross-sections of the key guiding seat and the linking member perpendicular to the central axis of the casing, the arc guiding groove extends in a circle centering on the central axis, and the arc route of the engaging slit is able to be in the circle.

The embodiments of the invention further disclose a key of the anti-picking device for the lock, which includes an engaging part, an orientating part and a teeth part. A cross-sectional view of the engaging part is in an arc shape, and the orientating part interconnects the engaging part with the teeth part.

In the preferred form shown, the orientating part has a non-circular cross-section.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
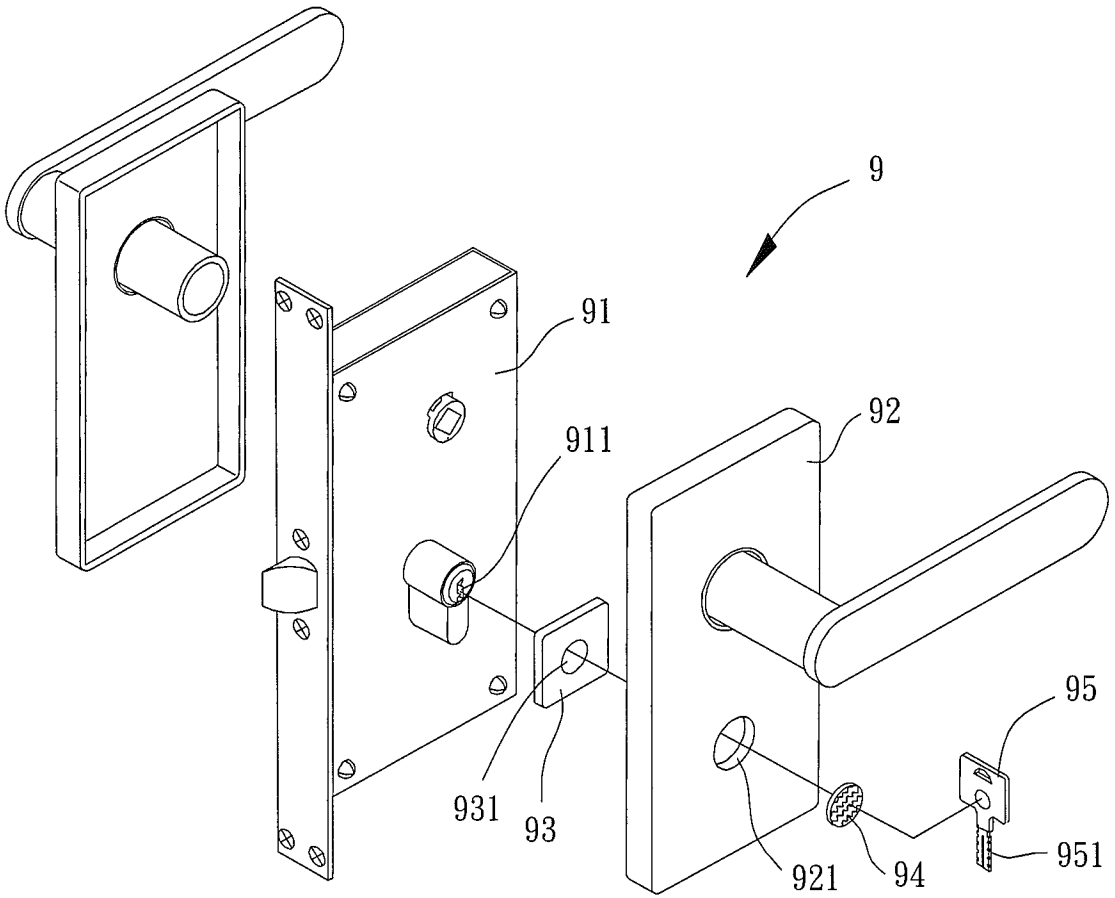
FIG. 1 PRIOR ART
FIG. 1 is a perspective and exploded view of a conventional anti-picking device.

In the various figures of the drawings, the same numerals designate the same or similar parts. Furthermore, when the terms "first," "second," "third," "fourth," "front," "rear," and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 2:
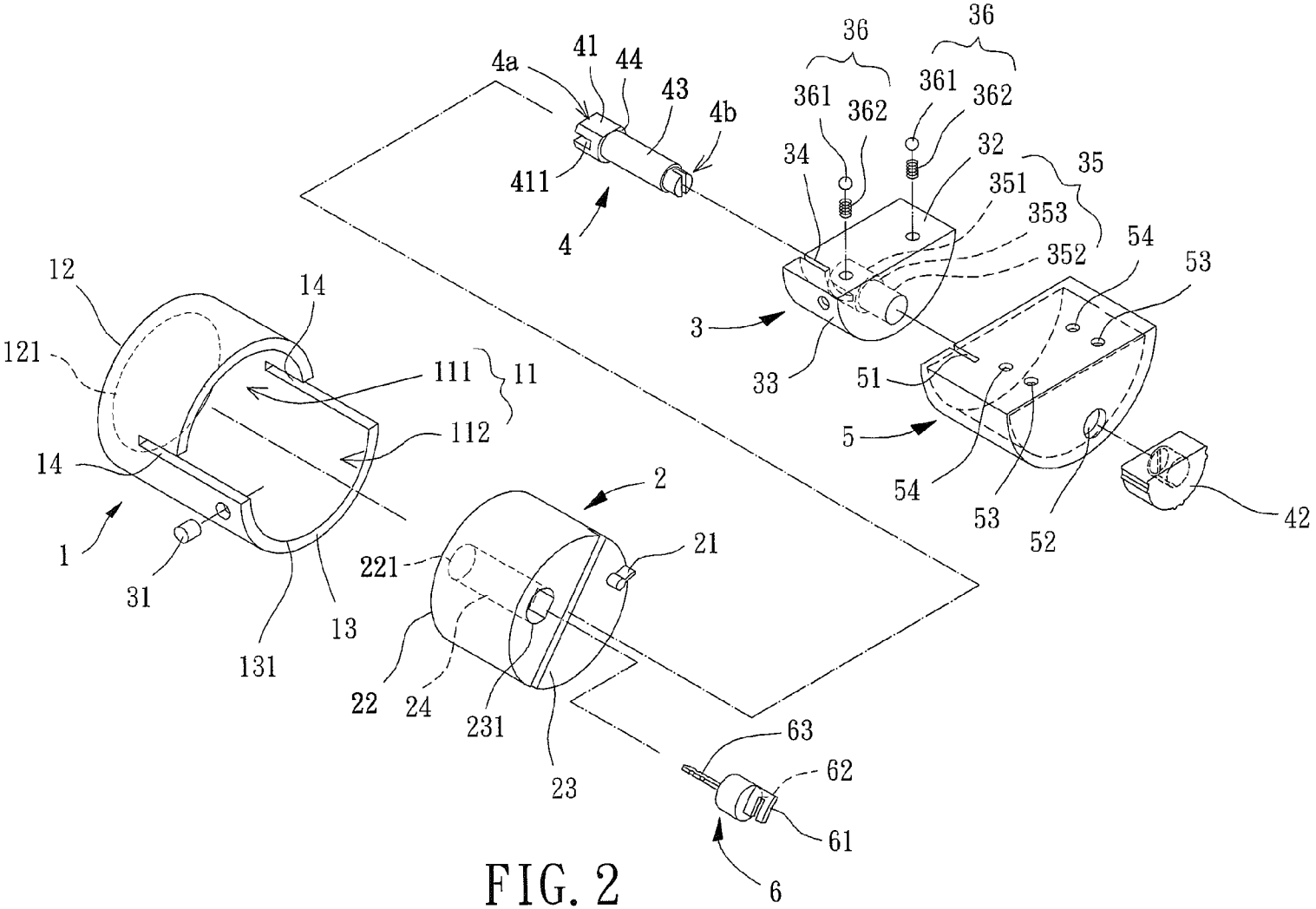
FIG. 2 is a perspective and exploded view of an anti-picking device for a lock according to a preferable embodiment of the invention.
Figure 3:
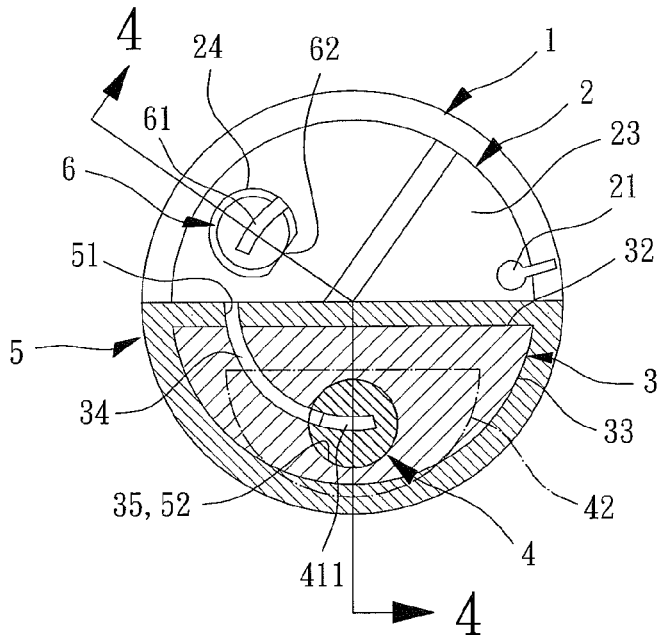
FIG. 3 is a cross-sectional view of the anti-picking device for the lock in an axial direction when an insertion hole misaligns with a receiving hole.
Figure 4:
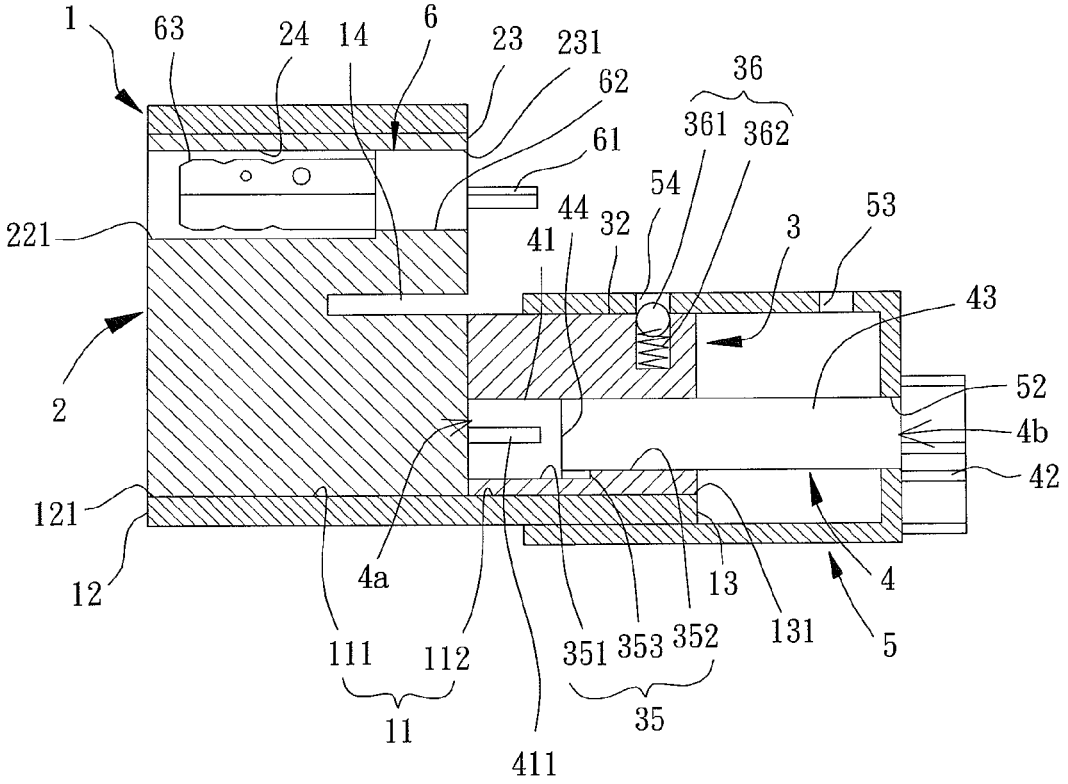
FIG. 4 is another cross-sectional view of the anti-picking device for the lock in a direction perpendicular to the axial direction when the insertion hole misaligns with the receiving hole.

Referring to FIGS. 2, 3 and 4, a preferable embodiment of an anti-picking device for a lock and a key thereof are shown, which can be applied to various kinds of locks, such as casing locks, door locks, U-locks, steering locks, etc. The anti-picking device includes a casing 1, a rotating body 2, a key guiding seat 3 and a linking member 4. Both of the rotating body 2 and the key guiding seat 3 are received in the casing 1, while the linking member 4 is rotatably arranged in the key guiding seat 3.

The casing 1 includes a compartment 11 receiving the rotating body 2 and the key guiding seat 3. The casing 1 is in a tubular shape and has a first end 12 and a second end 13 serving as two opposite and axial ends of the casing 1, which are spaced from each other in an axial direction of the casing 1. The first end 12 has a first opening 121, while the second end 13 has a second opening 131, with the first and second openings 121, 131 communicating with the compartment 11. Specifically, the compartment 11 of the casing 1 is separated into a first part 111 communicating with the first opening 121 and a second part 112 communicating with the second opening 131. The first end 12 of the casing 1 is adapted to be mounted on a lock, and a keyhole of the lock is arranged within an opening range of the first opening 121. Moreover, the casing 1 can further have two sliding grooves 14 extending in the axial direction, and the two sliding grooves 14 are arranged close to a boundary between the first and second parts 111, 112. Particularly, in this embodiment, a section of the casing 1 defining the first part 111 is in a full tubular shape, and another section of the casing 1 defining the second part 112 is in a half tubular shape. However the shape of the casing 1 is not limited thereby. The above arrangement of the casing 1 is used for a part of the rotating body 2 facing away from the first end 12 to be exposed to the outside of the casing 1 when the rotating body 2 and the key guiding seat 3 are received in the casing 1.

The rotating body 2 is rotatably received in the compartment 11 of the casing 1. The rotating body 2 has an actuated member 21 for a user to operate, so that the rotating body 2 can be operated to rotate about a central axis of the casing 1 within a rotation range, with the central axis extending in the axial direction. In this embodiment, the rotating body 2 is in a cylindrical shape and is rotatably received in the first part 111 of the compartment 11. The rotating body 2 further includes a first end face 22 and a second end face 23, with the first end face 22 facing the first opening 121 of the casing 1 and the second end face 23 facing the second opening 131 thereof. The actuated member 21 is preferably disposed on the second end face 23. Furthermore, the rotating body 2 also has an insertion hole 24 penetrating the rotating body 2 in the axial direction, which is a through hole extending from the first end face 22 to the second end face 23. Therefore, an end of the insertion hole 24 forms a third opening 221 in the first end face 22, and the other end of the insertion hole 24 forms a fourth opening 231 in the second end face 23. Besides, the third opening 221 keeps in the opening range of the first opening 121 when the rotating body 2 rotates within the said rotation range. Please note that, preferably, the insertion hole 24 has a front part connecting with the fourth opening 231 and a rear part connecting with the third opening 221, and a cross-sectional view of the front part in the axial direction is preferably non-circular, which will be further illustrated.

The key guiding seat 3 is also received in the compartment 11 of the casing 1 and abuts against the second end face 23 of the rotating body 2. Specifically, a cross-sectional view of the key guiding seat 3 in the axial direction is a semicircular shape, and the key guiding seat 3 is fixed in the second part 112 of the casing 1 by a fixing member 31, so that a part of the second end face 23 where the actuated member 21 is disposed is revealed. With the semicircular shape, the key guiding seat 3 has a flat wall 32 and an arc wall 33, which are connected in a circulating way to form the lateral periphery of the key guiding seat 3. The key guiding seat 3 further includes an arc guiding groove 34 and a receiving hole 35. The arc guiding groove 34 extends from the flat wall 32 to the receiving hole 35, and the receiving hole 35 penetrates through the key guiding seat 3 in the axial direction and communicates with the arc guiding groove 34. Specifically, in this embodiment, the receiving hole 35 includes a first section 351, a second section 352 and a first abutting face 353 formed at a boundary between the first and second sections 351, 352 by the difference of the cross-sections of the first and second sections 351, 352, with the cross-section of the first section 351 being larger than that of the second section 352. Particularly, the first section 351 is close to the rotating body 2 and communicates with the arc guiding groove 34, while the second section 352 is away from the rotating body 2, so that the first abutting face 353 faces the rotating body 2.

The linking member 4 is preferably in the form of a shaft rotatably received in the receiving hole 35 of the key guiding seat 3 and is able to slide in the axial direction relatively to the casing 1. The linking member 4 has a first end **4*a* and a second end 4*b*. An engaging part 41 of the linking member 4 forms the first end 4*a* and extends toward the rotating body 2, while the second end 4*b* extends away from the rotating body 2 and out of the receiving hole 35 for a handle 42 to be mounted thereon. A rod part 43 forming the second end 4*b* is arranged between the engaging part 41 and the handle 42, and a second abutting face 44 is formed at a boundary between the engaging and rod parts 41, 43 by the difference of the cross-sections of the engaging and rod parts 41, 43, with the cross-section of the engaging part 41 being larger than that of the rod part 43. Particularly, in this embodiment, the engaging part 41 is in the first section 351 of the receiving hole 35 initially; with the second abutting face 44 abutting against the first abutting face 353 of the receiving hole 35, so that the linking member 4 is prevented from coming off the key guiding seat 3 via the second section 352. Specifically, the cross-section of the engaging part 41 is in correspondence with that of the front part of the insertion hole 24, which is preferably non-circular, so that the engaging part 41 can be pushed to insert into the insertion hole 24 in a specific orientation, pass through the front part, and rotate in the rear part of the insertion hole 24. Besides, the engaging part 41 preferably has an engaging slit 411 extending in an arc route about the central axis of the casing 1**.

Furthermore, in order to provide an improved protection for the key guiding seat 3, it is preferable that the present embodiment further includes an outer shield 5. The outer shield 5 is disposed at the second end 13 of the casing 1, is able to slide relatively to the casing 1, and covers the key guiding seat 3. The second end **4*b* of the linking member 4 penetrates the outer shield 5, and the handle 42 mounted on the second end 4*b* is disposed outside the outer shield 5. Specifically, the outer shield 5 is arranged around the second part 112 of the casing 1 and is able to slide toward or backward relatively to the first end 12. The outer shield 5 can be inserted into the two sliding grooves 14 within a range limited by the bottom walls of the sliding grooves 14. Particularly, the outer shield 5 has a notch 51 communicating with the arc guiding groove 34 of the key guiding seat 3 and a through hole 52 for the second end 4*b* of the linking member 4** to pass through.

Furthermore, in order to achieve a desirable positioning efficiency of the outer shield 5, the outer shield 5 can further have a first positioning member 53 and a second positioning member 54, while the key guiding seat 3 also has at least one positioning module 36 correspondingly. The at least one positioning module 36 can be engaged with the first positioning member 53 or the second positioning member 54 to position the outer shield 5 in a first position or a second position. Speaking in detail, in the present embodiment, the number of the at least one positioning module 36 is two. Each of the positioning modules 36 has a ball 361 and an elastic member 362, and both of the first and second positioning members 53, 54 are a pair of holes. With the outer shield 5 being axially slid relatively to the key guiding seat 3, the balls 361 of the positioning modules 36 can be engaged with the pair of holes serving as the first positioning member 53 to position the outer shield 5 in the first position or engaged with the other pair of holes serving as the second positioning member 54 to position the outer shield 5 in the second position.

Please refer to FIGS. 2 and 3. A key 6 with a specific configuration is provided for operating the lock via the anti-picking device. The key 6 has an engaging part 61, an orientating part 62 and a teeth part 63. The engaging part 61 can be detachably coupled with the engaging slit 411 of the engaging part 41 of the linking member 4, so that the linking member 4 can drive the key 6 to operate the lock. Specifically, a cross-sectional view of the engaging part 61 is in an arc shape corresponding to the arc route of the engaging slit 411 and is able to slide along the arc guiding groove 34 and the notch 51. Moreover, in order to let the engaging part 61 slide across the arc guiding groove 34 and the notch 51 and couple with the engaging slit 411 and in cross-sections of the key guiding seat 3, the linking member 4 and the outer shield 5 perpendicular to the central axis of the casing 1, the arc guiding groove 34 and notch 51 extend in a circle centering on the central axis. The linking member 4 is able to be driven for the arc route of the engaging slit 411 to be in the circle. The orientating part 62 interconnects the engaging part 61 with the teeth part 63 and has a cross-section corresponding to that of the front part of the insertion hole 24. Thus the key 6 can only be inserted into the insertion hole 24 in a particular orientation without rotating in the front part of the insertion hole 24. As a result, with the orientating part 62, the engaging part 61 can smoothly pass through the arc guiding groove 34 and notch 51 and slide into the engaging slit 411 when the key 6 is driven by the present anti-picking device. The teeth part 63 is adapted to be inserted into the keyhole and to operate the lock.

Referring to FIGS. 3 through 7, the operation of the embodiment of the present anti-picking device is shown. Please refer to FIGS. 3 and 4. The insertion hole 24 of the rotating body 2 is revealed to the outside of the casing 1, and the positioning modules 36 engages with the second positioning member 54 to position the outer shield 5 in the second position before the key 6 is inserted into the insertion hole 24. In this situation, the keyhole of the lock is misaligned with the insertion hole 24, and the receiving hole 35 is apart from the insertion hole 24, so that the keyhole is concealed under the rotating body 2 and is inaccessible via the insertion hole 24. Furthermore, the key 6 can be inserted into the insertion hole 24, with the engaging part 61 protruding out of the insertion hole 24 via the fourth opening 231, with the orientating part 62 received in the front part of the insertion hole 24, and with the teeth part 63 pointing toward the first end 12 of the casing 1.

Figure 5:
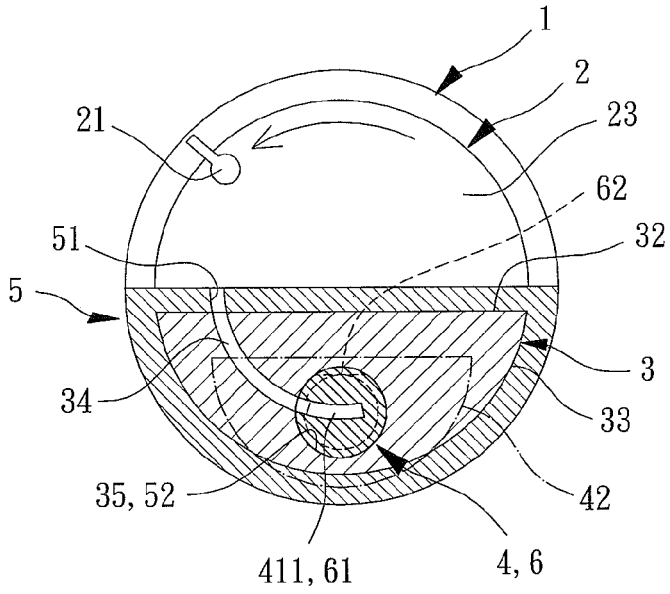
FIG. 5 is the cross-sectional view of the anti-picking device for the lock in the axial direction when the insertion hole aligns with the receiving hole.
Figure 6:
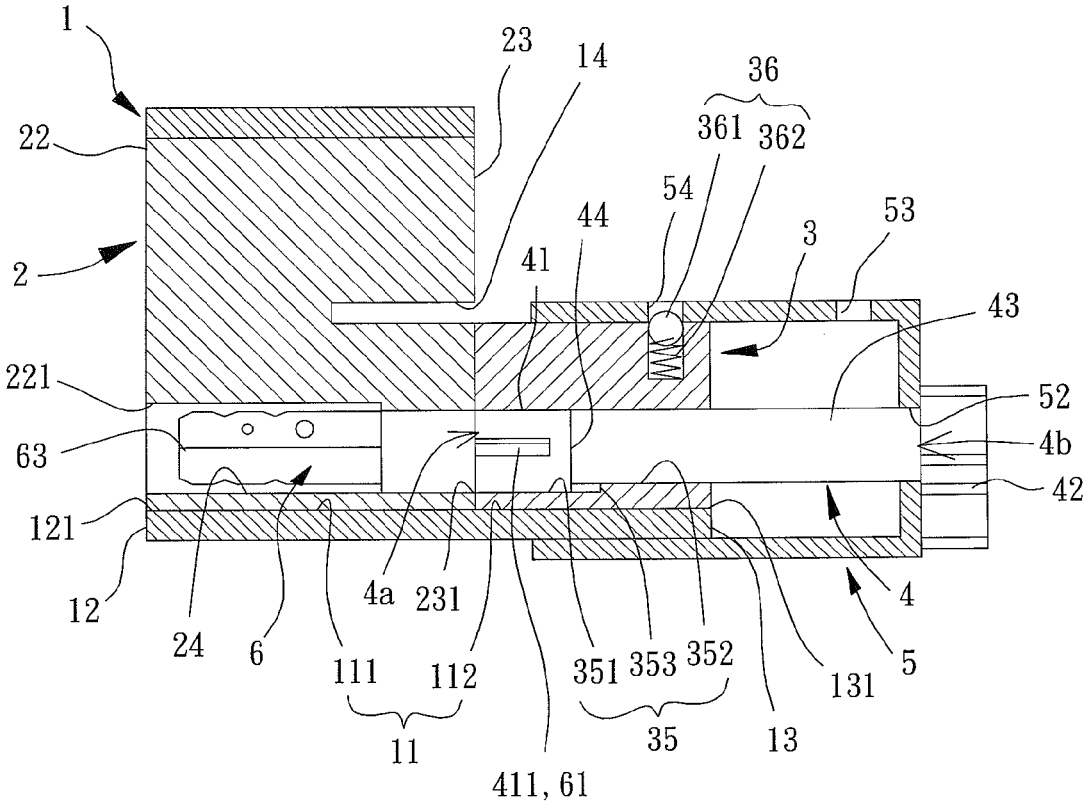
FIG. 6 is another cross-sectional view of the anti-picking device for the lock in the direction perpendicular to the axial direction when the insertion hole aligns with the receiving hole.

Please continue to FIGS. 5 and 6. A user can drive the rotating body 2 via the actuated member 21 to rotate about the central axis of the casing 1 in a direction shown by the arrow in FIG. 5. Accordingly, the engaging part 61 of the key 6 can sequentially go through the notch 51 and the arc guiding groove 34 and then reach the first section 351 of the receiving hole 35 for the engaging part 61 to engage with the engaging slit 411. With the above operation, the insertion hole 24 of the rotating body 2 is now aligned and communicating with the keyhole of the lock and the receiving hole 35 of the key guiding seat 3.

Figure 7:
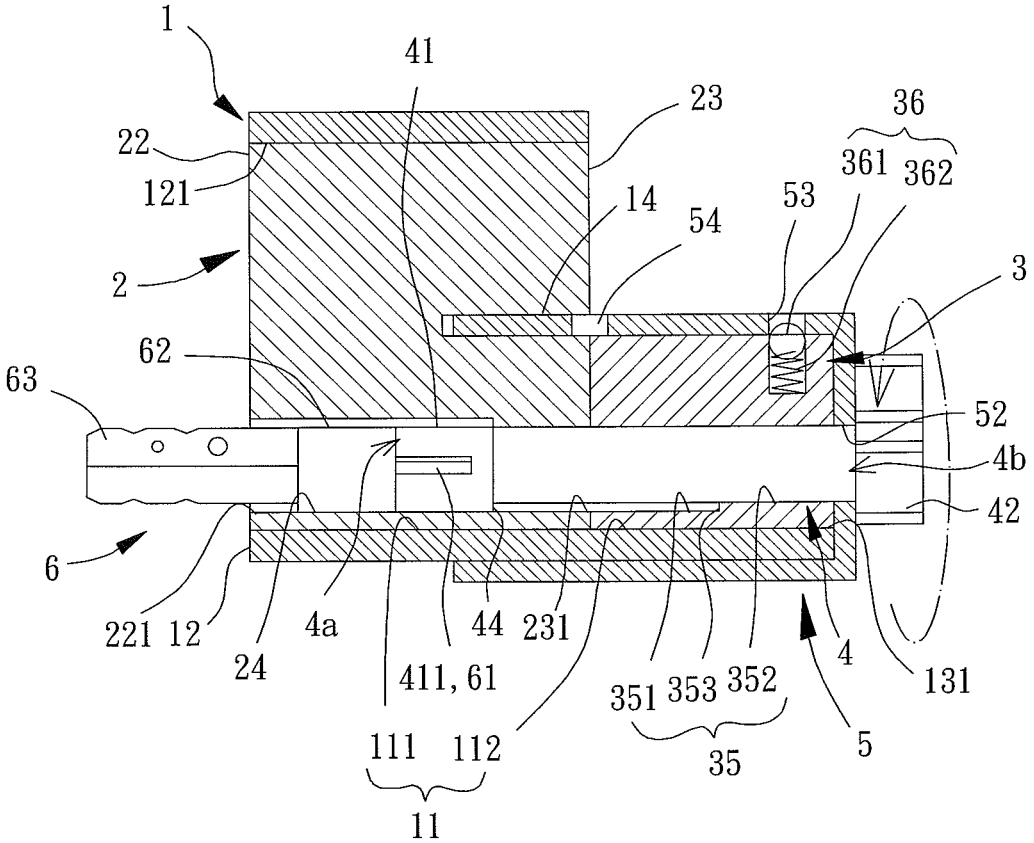
FIG. 7 is another cross-sectional view of the anti-picking device for the lock in the direction perpendicular to the axial direction with an outer shield in a first position.

Finally, referring to FIG. 7, the linking member 4 can drive the key 6 to move toward the lock for the teeth part 63 to insert into the keyhole and the engaging part 41 to be received in the rear part of the insertion hole 24 when the linking member 4 as well as the outer shield 5 is pushed toward the first end 12 of the casing 1. The outer shield 5 continues moving until the positioning modules 36 engages with the first positioning member 53 to position the outer shield 5 in the first position. Consequently, a user can drive the key 6 to rotate in the insertion hole 24 so as to operate the lock via the teeth part 63 of the key 6 in the keyhole.

In sum, the present anti-picking device is characterized in the following points. First, with the rotating body 2 being rotated relatively to the casing 1, the rotating body 2 can conceal the keyhole to prevent the keyhole from being picked and can reveal the keyhole by the insertion hole 24 only for the key 6 when the key 6 is used to operate the lock. As a result, the anti-picking device can efficiently prevent the keyhole of the lock from being picked. Second, since the engaging part 41 is hidden in the receiving hole 35 of the key guiding seat 3 and the arc routes of the arc guiding groove 34 and the notch 51 are undetectable, only the key 6 with the engaging part 61 having a corresponding arc shape can be used in the anti-picking device. Therefore, another guard strategy is provided by the hidden engaging part 41 and the undetectable arc routes of the arc guiding groove 34 and the notch 51. Third, with the third opening 221 keeping in the opening range of the first opening 121 when the rotating body 2 rotates within the rotation range, tolerances to undesirable change in size of the third opening 221 and to undesirable shift in the position of the actuated member 21 in manufacture are enlarged. Thus, the key 6 may not be blocked by the wall defining the first opening 121 when protruding out of the receiving hole 24 via the third opening 221.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. An anti-picking device for a lock, comprising:

a casing having a first end, a second end and a compartment, wherein the first and second ends serve as two opposite ends of the casing in an axial direction, the first end has a first opening while the second end has a second opening, and the first and second openings communicate with the compartment;

a rotating body rotatably received in the compartment, wherein the rotating body has a first end face facing the first opening, a second end face facing the second opening, an actuated member adapted to rotate the rotating body about a central axis of the casing within a rotation range, and an insertion hole extending from the first end face to the second end face in the axial direction to form a third opening in the first end face and a fourth opening in the second end face;

a key guiding seat received in the compartment and having an arc guiding groove and a receiving hole, wherein the arc guiding groove communicates with the receiving hole, and the receiving hole penetrates through the key guiding seat in the axial direction; and a linking member rotatably received in the receiving hole of the key guiding seat and having an engaging part at a first end while a second end of the linking member extends away from the rotating body and out of the receiving hole, wherein the third opening keeps in an opening range of the first opening when the rotating body rotates within the said rotation range for the insertion hole to communicate with or be apart from the receiving hole, wherein the rotating body is rotatable about the central axis of the casing, wherein the casing and the key guiding seat are non-rotatable about the central axis of the casing, and wherein the first end of the casing is flush with the first end face of the rotating body.

2. The anti-picking device for the lock as claimed in claim 1, wherein a cross-section of a front part of the insertion hole is non-circular.

3. The anti-picking device for the lock as claimed in claim 2, wherein a cross-section of the engaging part is in correspondence with the cross-section of the front part of the insertion hole.

4. The anti-picking device for the lock as claimed in claim 1 further comprising an outer shield, wherein the outer shield is disposed at the second end of the casing and able to slide relatively to the casing, and wherein the second end of the linking member penetrates the outer shield.

5. The anti-picking device for the lock as claimed in claim 4, wherein the key guiding seat has at least one positioning module while the outer shield further has a first positioning member and a second positioning member, with the at least one positioning module able to be engaged with the first positioning member or second positioning member.

6. The anti-picking device for the lock as claimed in claim 1, wherein the engaging part has an engaging slit extending in an arc route about the central axis of the casing.

7. The anti-picking device for the lock as claimed in claim 6, wherein, in cross-sections of the key guiding seat and the linking member perpendicular to the central axis of the casing, the arc guiding groove extends in a circle centering on the central axis, and wherein the arc route of the engaging slit is able to be in the circle.

8. The anti-picking device for the lock as claimed in claim 1, wherein the receiving hole has a first section and a second section, with the first section communicating with the arc guiding groove and able to receive the engaging part of the linking member, and with a cross-section of the first section of the receiving hole being larger than a cross-section of the second section.

9. A key of the anti-picking device for the lock as claimed in claim 1, with the key comprising an engaging part, an orientating part and a teeth part, wherein a cross-sectional view of the engaging part is in an arc shape, and wherein the orientating part interconnects the engaging part with the teeth part.

10. The key of the anti-picking device for the lock as claimed in claim 9, wherein the orientating part has a non-circular cross-section.

11. The anti-picking device for the lock as claimed in claim 1, wherein the actuated member is a protrusion arranged on the second end face of the rotating body.

12. An anti-picking device for a lock, comprising:

a casing having a first end, a second end and a compartment, wherein the first and second ends serve as two opposite ends of the casing in an axial direction, wherein the first end has a first opening while the second end has a second opening, and wherein the first and second openings communicate with the compartment;

a rotating body rotatably received in the compartment, wherein the rotating body has a first end face facing the first opening, a second end face facing the second opening, an actuated member adapted to rotate the rotating body about a central axis of the casing within a rotation range, and an insertion hole extending from the first end face to the second end face in the axial direction to form a third opening in the first end face and a fourth opening in the second end face;

a key guiding seat received in the compartment and having an arc guiding groove and a receiving hole, wherein the arc guiding groove communicates with the receiving hole, and wherein the receiving hole penetrates through the key guiding seat in the axial direction;

a linking member rotatably received in the receiving hole of the key guiding seat and having an engaging part at a first end while a second end of the linking member extends away from the rotating body and out of the receiving hole, wherein the third opening keeps in an opening range of the first opening when the rotating body rotates within the said rotation range for the insertion hole to communicate with or be apart from the receiving hole; and an outer shield disposed at the second end of the casing and able to slide relatively to the casing, wherein the second end of the linking member penetrates the outer shield, and wherein the outer shield has a notch communicating with the arc guiding groove of the key guiding seat.

13. The anti-picking device for the lock as claimed in claim 12, wherein, in cross-sections of the key guiding seat and the outer shield perpendicular to the central axis of the casing, the arc guiding groove and the notch extend are in a circle centering on the central axis.

14. The anti-picking device for the lock as claimed in claim 13, wherein the engaging part has an engaging slit extending in an arc route about the central axis of the casing, and, in cross-sections of the key guiding seat, the linking member and the outer shield perpendicular to the central axis of the casing, the arc route of the engaging slit is able to be in the circle.

15. An anti-picking device for a lock, comprising:

a casing having a first end, a second end and a compartment defining a central axis, wherein the first and second ends serve as two opposite ends of the casing in an axial direction along the central axis, wherein the first end has a first opening while the second end has a second opening, wherein the compartment and the first opening each have a cylindrical inner periphery of a circular shape with a center on the central axis, and wherein the first and second openings communicate with the compartment;

a rotating body rotatably received about the central axis in the compartment, wherein the rotating body has a first end face facing the first opening, a second end face flush with the second opening, an actuated member adapted to rotate the rotating body about the central axis of the casing within a rotation range, and an insertion hole extending from the first end face to the second end face in the axial direction to form a third opening in the first end face and a fourth opening in the second end face;

a key guiding seat non-rotatably received in the compartment and having an arc guiding groove and a receiving hole, wherein the arc guiding groove communicates with the receiving hole, and wherein the receiving hole penetrates through the key guiding seat in the axial direction; and a linking member rotatably received in the receiving hole of the key guiding seat and having an engaging part at a first end while a second end of the linking member extends away from the rotating body and out of the receiving hole, wherein the third opening keeps in an opening range of the first opening when the rotating body rotates within the said rotation range for the insertion hole to communicate with or be apart from the receiving hole.

* * * * *